US007494519B2

(12) United States Patent
Fletcher et al.

(10) Patent No.: US 7,494,519 B2
(45) **Date of Patent: *Feb. 24, 2009**

(54) ABRASIVE AGGLOMERATE POLISHING METHOD

(75) Inventors: Timothy D. Fletcher, Lino Lakes, MN (US); Paul S. Lugg, Woodbury, MN (US); Vincent D. Romero, Maplewood, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 540 days.

This patent is subject to a terminal disclaimer.

(21) Appl. No.: 11/191,711

(22) Filed: Jul. 28, 2005

(65) Prior Publication Data

US 2007/0026770 A1 Feb. 1, 2007

(51) Int. Cl.
*B24D 11/00* (2006.01)

(52) U.S. Cl. ..... 51/295; 51/297; 51/298; 51/307; 51/308; 51/309; 451/528; 451/533; 451/539; 451/28; 451/36

(58) Field of Classification Search ..... 51/295, 51/297, 298, 307–309; 451/528, 533, 539, 451/28, 36

See application file for complete search history.

(56) References Cited

U.S. PATENT DOCUMENTS

| | | | |
|---|---|---|---|
| 4,311,489 | A | 1/1982 | Kressner |
| 4,652,275 | A | 3/1987 | Bloecher et al. |
| 4,799,939 | A | 1/1989 | Bloecher et al. |
| 5,078,753 | A | 1/1992 | Broberg et al. |
| 5,152,917 | A | 10/1992 | Pieper et al. |
| 5,304,223 | A | 4/1994 | Pieper et al. |
| 5,435,816 | A | 7/1995 | Spurgeon et al. |
| 5,437,754 | A | 8/1995 | Calhoun |
| 5,454,844 | A | 10/1995 | Hibbard et al. |
| 5,562,745 | A | 10/1996 | Gagliardi et al. |
| 5,632,668 | A | 5/1997 | Lindholm et al. |
| 5,651,729 | A | 7/1997 | Benguerel |

(Continued)

FOREIGN PATENT DOCUMENTS

| | | |
|---|---|---|
| JP | 63-274782 | 11/1988 |

(Continued)

OTHER PUBLICATIONS

Fletcher, U.S. Appl. No. 11/191,722, filed Jul. 28, 2005, titled "Self-Contained Conditioning Abrasive Article".

*Primary Examiner*—Michael A Marcheschi
(74) *Attorney, Agent, or Firm*—James A. Baker

(57) ABSTRACT

Provided is a method of polishing comprising providing a workpiece, providing a fixed abrasive article, providing conditioning particles, and relatively moving the workpiece and the fixed abrasive article in the presence of the conditioning particles to modify the surface of the workpiece and to condition the fixed abrasive. The fixed abrasive article comprises a substrate having a first surface and a region of abrasive composites distributed on the first surface of the substrate. The abrasive composites include a composite binder and abrasive particles, which may be in abrasive agglomerates together with a matrix material. The abrasive particles are harder than the workpiece. The conditioning particles are sufficient to condition one or more of the composite binder, matrix material, and abrasive agglomerates. The hardness of the conditioning particles is less than the hardness of the workpiece and they do not substantially polish the workpiece.

21 Claims, 1 Drawing Sheet

U.S. PATENT DOCUMENTS

| | | | |
|---|---|---|---|
| 5,820,450 | A | 10/1998 | Calhoun |
| 5,840,090 | A | 11/1998 | Ho et al. |
| 5,958,794 | A | 9/1999 | Bruxvoort et al. |
| 5,975,988 | A | 11/1999 | Christianson |
| 6,217,413 | B1 | 4/2001 | Christianson |
| 6,319,108 | B1 | 11/2001 | Adefris et al. |
| 6,364,747 | B1 | 4/2002 | Gagliardi |
| 6,485,355 | B1 | 11/2002 | Economikos et al. |
| 6,551,366 | B1 | 4/2003 | D'Souza et al. |
| 6,595,831 | B1 | 7/2003 | Hirokawa et al. |
| 6,602,117 | B1 | 8/2003 | Chopra et al. |
| 6,645,624 | B2 | 11/2003 | Adefris et al. |
| 6,830,500 | B2 | 12/2004 | Chopra et al. |
| 6,899,611 | B2 | 5/2005 | Reinhardt et al. |
| 7,101,819 | B2 | 9/2006 | Rosenflanz et al. |
| 7,169,031 | B1 * | 1/2007 | Fletcher et al. ..... 451/528 |
| 2002/0077036 | A1 | 6/2002 | Roberts et al. |
| 2003/0100246 | A1 | 5/2003 | Hirokawa et al. |
| 2004/0014318 | A1 | 1/2004 | Chopra et al. |
| 2004/0166779 | A1 | 8/2004 | Balijepalli et al. |
| 2004/0235407 | A1 | 11/2004 | Grunwald |

FOREIGN PATENT DOCUMENTS

| | | |
|---|---|---|
| JP | 2000-339672 | 12/2000 |
| WO | WO 03/008151 A1 | 1/2003 |

* cited by examiner

ABRASIVE AGGLOMERATE POLISHING METHOD

TECHNICAL FIELD

This invention relates to a method for polishing a workpiece using agglomerates of a first abrasive suitable for abrading or polishing the workpiece and conditioning particles suitable for conditioning or dressing agglomerates of the first abrasive.

BACKGROUND

Coated abrasive articles typically consist of a layer of abrasive grits adhered to a backing. Three-dimensional, textured, fixed abrasive articles include a plurality of abrasive particles and a binder in a pattern. After use, the abrasive grits become dull and worn, so an additional process is used to expose fresh abrasive.

Slurries containing loose abrasive particles dispersed in a liquid and a polishing pad also have been used for polishing. Lapping is a grinding process that typically involves a slurry of loose abrasive grits, such as aluminum oxide in a liquid, flowed across a rotating lap plate, typically a metal such as cast iron. This provides an abrasive film between the polishing pad and the workpiece that enables stock removal from a single side or from both sides simultaneously.

SUMMARY OF INVENTION

Briefly, the present invention provides a method of polishing comprising providing a workpiece, providing a fixed abrasive article comprising a substrate having a first surface and a region of abrasive composites distributed on the first surface of the substrate, the abrasive composites including a composite binder and abrasive particles of a first hardness, wherein the first hardness is higher than the workpiece hardness, providing conditioning particles sufficient to condition the composite binder and having a second hardness that is less than the hardness of the workpiece, and relatively moving the workpiece and the fixed abrasive article in the presence of the conditioning particles to condition the composite binder and to modify the surface of the workpiece. The abrasive particles of the fixed abrasive article can be provided together with a matrix material in agglomerates. In this case, the conditioning particles can be sufficient to condition the matrix material of the agglomerates.

In another aspect, the invention provides a method of polishing comprising providing a workpiece, providing a fixed abrasive article comprising a substrate having a first surface and a region of abrasive composites distributed on the first surface of the substrate, the abrasive composites including a composite binder and abrasive agglomerates, which agglomerates include abrasive particles of a first hardness together with a matrix material, and wherein the first hardness is higher than the workpiece hardness, providing a slurry of working fluid and conditioning particles, which particles have a second hardness that is less than the hardness of the workpiece and which is sufficient to condition the matrix material of the abrasive agglomerates, and, in the presence of the slurry and the conditioning particles, relatively moving the workpiece and the fixed abrasive article to modify the surface of the workpiece.

It is an advantage of one embodiment of the present invention to provide a polishing method using abrasive agglomerates in which the agglomerates are conditioned by conditioning particles which are provided by a slurry or in a fixed abrasive article such that the conditioning particles are capable of dressing abrasive agglomerates within an abrasive composite. With the present invention, the conditioning particles do not appreciably modify the surface of a workpiece while the primary abrasive in the fixed abrasive article does modify the surface of the workpiece when the workpiece and the fixed abrasive article are relatively moved against each other. In some embodiments of the present invention, the conditioning particles have an average particle size below the average particle size of the abrasive particles within the abrasive agglomerates in the abrasive composite. In another aspect, the fixed abrasive article uses conditioning particles provided on a fixed abrasive article, such that the conditioning particles can be released during abrasive finishing.

In the polishing method of present invention, the abrasive particles (first hardness) in the fixed abrasive article are capable of abrading a workpiece while the conditioning particles (second hardness), provided as part of the fixed abrasive article or provided as a separate slurry, condition or abrade the matrix material of the abrasive agglomerates, but have little, if any, effect on the workpiece. For example, a typical lapping process may take several minutes to several hours to polish a workpiece, but the conditioning particles (of the second hardness) alone would take at least several days, weeks, or months to polish a similar workpiece, if polishing eventually occurred.

During an abrasive finishing process the conditioning particles from the slurry or the "self-conditioning" abrasive article promote breakdown of the fixed abrasive by acting upon the matrix material, which in turn keeps active cutting points on the surface of the abrasive available to modify the surface of the workpiece. The conditioning particles need not be of sufficient hardness or size to cause any significant workpiece removal rate attributable to these particles (as is required for slurry lapping). The increased presence of active cutting points on the abrasive surface increases the removal rate and avoids the removal rate drop commonly observed for fixed abrasives used on hard workpieces.

Other features and advantages of the invention will be apparent from the following detailed description of the invention and the claims. The above summary is not intended to describe each illustrated embodiment or every implementation of the present disclosure. The figures and the detailed description that follow more particularly exemplify certain preferred embodiments utilizing the principles disclosed herein.

DETAILED DESCRIPTION OF PRESENTLY PREFERRED EMBODIMENTS

Figure 1:
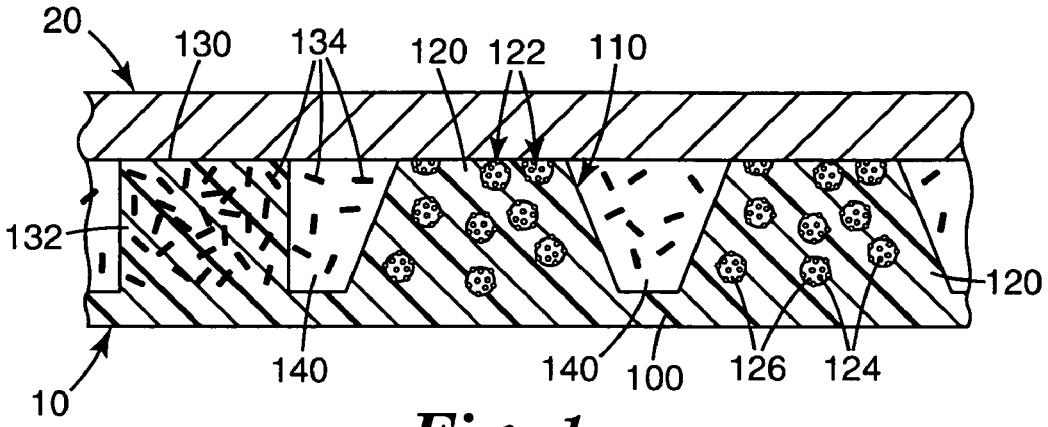
FIG. 1 shows a partial cross sectional view of an article useful in the invention shown in contact with a workpiece, which is not drawn to scale.

All numbers are herein assumed to be modified by the term "about," unless stated otherwise. The recitation of numerical ranges by endpoints includes all numbers subsumed within that range (e.g., 1 to 5 includes 1, 1.5, 2, 2.75, 3, 3.80, 4, and 5).

The present invention provides a method of polishing comprising providing a workpiece, providing a fixed abrasive article, providing conditioning particles, and relatively moving the workpiece and the fixed abrasive article in the presence of the conditioning particles to modify the surface of the workpiece. The fixed abrasive article comprises a substrate having a first surface and a region of abrasive composites distributed on the first surface of the substrate. The abrasive composites include a composite binder and abrasive particles and/or abrasive agglomerates. Agglomerates comprise abrasive particles together with a matrix material. The abrasive particles have a first hardness that is higher than the workpiece hardness. The conditioning particles are sufficient to condition the composite binder, and/or the matrix material of the abrasive agglomerates, and have a second hardness that is less than the hardness of the workpiece. The fixed abrasive article and the workpiece are relatively moved against each other in the presence of the conditioning particles to modify the surface of the workpiece and to condition the composite binder, and/or the matrix material of the abrasive agglomerates in the fixed abrasive article.

In another embodiment, the invention provides a method of polishing comprising providing a workpiece, providing a fixed abrasive article, providing a slurry of working fluid and conditioning particles, and relatively moving the workpiece and the fixed abrasive article in the presence of the working fluid and conditioning particles to modify the surface of the workpiece. The fixed abrasive article comprises a substrate having a first surface and a region of abrasive composites distributed on the first surface of the substrate. The abrasive composites include a composite binder and abrasive agglomerates. The agglomerates include abrasive particles of a first hardness together with a matrix material, wherein the first hardness is higher than the workpiece hardness. The conditioning particles have a second hardness that is less than the hardness of the workpiece, yet which is sufficient to condition the composite binder and/or the matrix material of the abrasive agglomerates. The workpiece is polished by relatively moving the workpiece and the fixed abrasive article to modify the surface of the workpiece in the presence of the slurry of working fluid and conditioning particles.

The present invention uses a fixed abrasive article for polishing a workpiece, which workpiece has a certain hardness. The abrasive article comprises a substrate that has a top or first surface and a bottom or second surface. On the first surface of the substrate of the abrasive article there is a (at least one) region of distributed abrasive composites. These abrasive composites include a composite binder and abrasive agglomerates. In one aspect, the agglomerates include abrasive particles of a first hardness together with a matrix material. The hardness of these abrasive particles in the agglomerates is higher than the hardness of the intended workpiece, such that these abrasive particles polish or abrade the workpiece during the intended use of the fixed abrasive article. Also on the first surface of the substrate of the abrasive article there can be a (at least one) region of distributed conditioning amalgams. These amalgams, or composites, or sub-assemblies, include an erodible binder and conditioning particles of a second hardness. This second hardness is less than the hardness of the workpiece, yet is sufficient to condition the matrix material of the abrasive agglomerates. Alternatively, or in combination, the conditioning particles can be provided in a slurry of conditioning particles with working fluid. Thus, this aspect of the invention provides a self-conditioning or in situ conditioning polishing method, wherein the conditioning particles act upon the matrix material, releasing new surfaces from within the abrasive agglomerates but preferably the conditioning particles do not abrade, erode, or scratch the workpiece. In some aspects, the conditioning particles also condition the composite binder, which is useful, for example, when the abrasive agglomerates are provided in a three-dimensional fixed abrasive article such that conditioning the abrasive article exposes new abrasive particles and/or new agglomerates.

In another embodiment, the present invention uses a fixed abrasive article for polishing a workpiece, where the workpiece has a Knoop hardness below about 2500 kg/mm$^2$. In this embodiment, the method uses a fixed abrasive article along with conditioning particles as described above. The abrasive composites comprise abrasive agglomerates, which agglomerates include abrasive particles that have a Knoop hardness above the workpiece hardness, or at least about 2500 kg/mm$^2$. These agglomerates include abrasive particles together with a matrix material. The conditioning particles are provided via a slurry or as part of the fixed abrasive article via conditioning composites or amalgams. As composites, the conditioning particles can be distributed on the first surface of the substrate and include an erodible binder along with conditioning particles. The conditioning particles having a Knoop hardness below the hardness of the workpiece and higher than the hardness of the matrix material of the abrasive agglomerates. Thus, various aspects of the invention provide a self-conditioning polishing method using an abrasive as described above.

In another embodiment, the present invention uses a fixed abrasive article for polishing a workpiece comprising a substrate having a first surface and a second surface, a region of abrasive composites distributed on the first surface of the substrate, the abrasive composites including a composite binder and abrasive agglomerates, which agglomerates include abrasive particles having a hardness of at least about 2500 kg/mm$^2$ together with a matrix material having a hardness of at least about 18 kg/mm$^2$; and a region of conditioning amalgams distributed on the first surface of the substrate, the amalgams including an erodible binder and conditioning particles sufficient to condition the composite binder and having a second hardness, which second hardness is less than 2500 kg/mm$^2$, about the same or greater than the hardness of the composite binder, and about the same or greater than the hardness of the matrix. In some aspects, the conditioning particles have an average particle size below the average particle size of the abrasive particles.

Further detail on fixed abrasive articles useful in the present invention is found in U.S. Pat. No. 7,169,031, and which is herein incorporated by reference.

The polishing method of the present invention may also further include a slurry abrasive, which can abrade or condition the matrix material and/or the composite binder, but preferably not abrade workpiece.

Turning now to useful abrasive articles, FIG. 1 shows abrasive article 10 in contact with workpiece 20. Abrasive article 10 is composed of several elements. Upon substrate 100 is provided abrasive composites 110, which include shaped regions of composite binder 120, and abrasive agglomerates 122. Abrasive agglomerates 122 include matrix material 126 together with particles of first abrasive 124. Also upon substrate 100 is provided a conditioning composite 130, which includes a shaped region of erodible binder 132, and conditioning particles 134. Particles of the conditioning particles 134 also are shown suspended in a working fluid within channels 140, which lie between conditioning composite 130 and abrasive composites 110. Channels 140 can direct slurry and working fluid movement during the use of abrasive article 10. The drawings are not to scale. In some embodiments, conditioning particles 134 have an average particle size close to, or lower than, the size of the abrasive particles, for example, conditioning particles 134 can have an average particle size of 125%, 100%, 75%, or even less, as compared to the average particle size of first abrasive 124. Conditioning particles preferably have an average particle size of at least about 50% of the average particle size of the abrasive particles. In addition, conditioning particles also can be included in composite binder 120. In the invention, abrasive article 10 and workpiece 20 are relatively moved against each other in the presence of conditioning particles 134, which typically are provided in a working fluid or slurry, shown suspended in flow channels 140, and/or are provided as part of conditioning composite 130. In the method of the invention, the workpiece can abrade conditioning composite 130, and/or erodible binder 132, to release conditioning particles. In addition, or in combination, erodible binder 132 may slowly dissolve during the method, releasing conditioning particles 134.

In one embodiment, two or three of the substrate 100, composite binder 120, and erodible binder 132 can be made of the same material. For example, a polymeric resin can be used as the binder for one or two of the abrasive features mentioned as well as for the substrate. Thus, FIG. 1 shows one option having substrate 100 integrally with composite binder 120 and erodible binder 132. In one aspect, a thin substrate is used with another supporting layer. The substrate and supporting layer can be different or can be the same material. They can be attached via any known means, such as via adhesive, pressure-sensitive adhesive, casting and curing, melt casting, etc. For example, a thin substrate 100 can be attached to a supporting layer of a material such as polyester or polycarbonate via an adhesive, such as a double-sided pressure-sensitive adhesive tape.

Figure 2A:
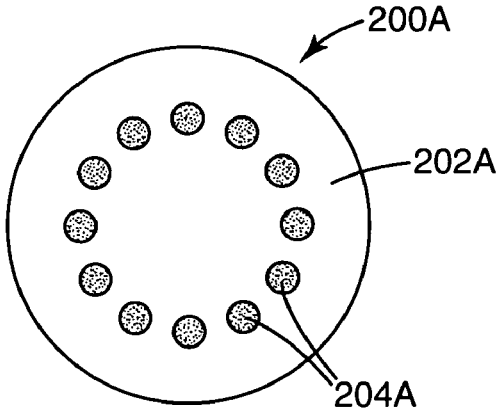
FIGS. 2A through 2D show exemplary schematic configurations of fixed abrasive articles useful with the invention with regions of abrasive composites and regions of conditioning composites.
Figure 2B:
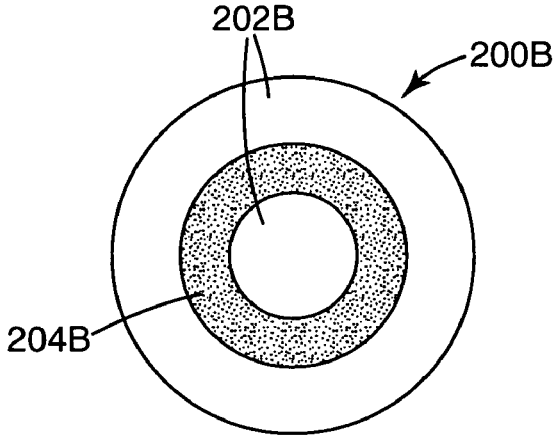
Figure 2C:
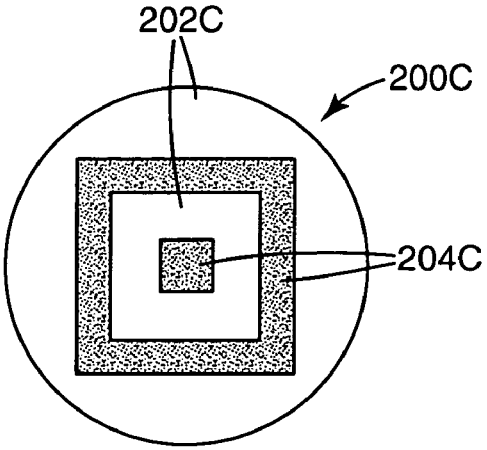
Figure 2D:
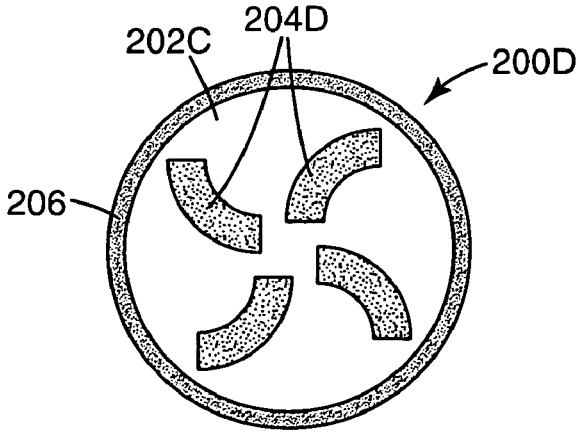

FIGS. 2A through 2D show exemplary configurations of fixed abrasive articles useful in the invention with regions of abrasive composites and regions of conditioning composites. More specifically, FIG. 2A shows abrasive article 200A with a general region or field of abrasive composites 202A and in selected regions within this field are provided regions of conditioning composite 204A, shown here in a circular layout. FIG. 2B shows abrasive article 200B with a general region or field of abrasive composites 202B and in selected regions within this field is provided an annular region of conditioning composite 204B. FIG. 2C shows abrasive article 200C with a general region or field of abrasive composites 202C and in selected regions within this field are provided regions of conditioning composite 204C, shown here in an annular rectangular layout. FIG. 2D shows abrasive article 200D with a general region or field of abrasive composites 202D and in selected regions within this field are provided regions of conditioning composite 204D, shown here in a design that is capable of directing working fluid and/or slurry toward the center of abrasive article 200D when the article is rotated in a clockwise direction. In addition, FIG. 2D shows slurry retainer 206 about the periphery of abrasive article 200D. Such a retainer can be used in many embodiments of the present invention in a location such as shown in FIG. 2D (about the periphery) or in other locations to retain slurry with the abrasive article for a desired duration. That is, the retainer can be about the entire periphery (as shown) or provided in intermittent regions, such as to control the amount of material retained. In addition, regions of conditioning composite can be provided to preferentially direct slurry and/or working fluid to, for example, carry liquid toward the center, such as shown in FIG. 2D with conditioning composite 204D. In alternative embodiments, the retainer can be designed to carry liquid away from the center, or in another desired path. The retainer may be abrasive composite, conditioning amalgams, a combination thereof, or still another material.

In other aspects, conditioning fluid-directing regions can be used independently of, or in cooperation with, the abrasive regions. For example, wipers comprising the resin of the matrix material, the composite binder, the erodible binder, or another material can be included in the design for moving, removing, and/or retaining conditioning material.

Substrates useful in the useful articles include those known useful in coated abrasive and fixed abrasives, such as polymeric film, cloth, paper, foam, nonwovens, treated or primed versions thereof, and combinations thereof. Examples include polyester films, polyolefin films (e.g., polyethylene and propylene film), polyamide films, polyimide films and the like. A thin substrate can be reinforced using another layer for support, such as a thicker film, or a polycarbonate sheet, for example. In addition, the abrasive article of the invention can be attached to a base or sheet or directly to a polishing apparatus or machine via any known route, for example, adhesives including pressure sensitive adhesives are useful.

The present invention uses abrasive composites comprising a plurality of abrasive agglomerates, which can be arranged in a single layer on a substrate or backing, and which can be arranged into "three-dimensional" structures wherein a plurality of abrasive particles or agglomerates extend throughout at least a portion of the thickness, such that eroding, abrading, or removing some of the abrasive particles from the structures or the agglomerates during use exposes additional abrasive particles capable of performing the abrasive function, and preferably maintaining the cut rate on the workpiece. In addition, the conditioning particles may dress or condition the composite binder, thereby exposing new abrasive particles or agglomerates. The abrasive composites may be abrasive particles or single agglomerates in a make coat and/or size coat, which includes the composite binder. Such single-layer abrasives are three-dimensional when the primary abrasive particles are distributed throughout the thickness of the structures or agglomerates rather than constituting a single layer of primary abrasive particles. The abrasive agglomerates comprise abrasive particles of a first hardness, and are selected to have a hardness sufficient to abrade the intended workpiece, for example, via fracture-based lapping or grinding. That is, these abrasive particles generally having a higher hardness than the hardness of the intended workpiece, and they can be termed "primary abrasive." Selection of these abrasive particles is thus driven by the intended workpiece. For example, in one aspect of the invention, the workpiece has a Knoop hardness (all in $kg/mm^2$) of at least about 1000, more preferably at least about 2000. In other aspects, the workpiece has a Knoop hardness of at least about 2200, or at least about 2500. Particular selection of abrasive particles and suitability for a particular workpiece is within the skill of the art, with harder abrasives needed for harder workpieces. For the hardest workpieces, the abrasive particles can be diamond, cubic boron nitride, boron carbide, silicon carbide, and other abrasive grit preferably having a hardness above 2200 $kg/mm^2$. In another aspect of the invention, the workpiece has a Knoop hardness of at least about 600-640 $kg/mm^2$, and the abrasive particles generally can be those listed above and any other abrasive grit preferably having a hardness above 640 $kg/mm^2$, such as alumina, zirconia, corundum, etc.

Conditioning composites or amalgams can be used in the present invention to supply conditioning particles. One example of such particles is abrasive grit that can form part of a slurry during use or in a polishing system. The conditioning particles have a hardness below that of the intended workpiece, such that minimal or no appreciable abrading or grinding of the workpiece results from the conditioning particles.

However, the conditioning particles have a hardness about the same or above that of the matrix material of the abrasive agglomerates, and the conditioning particles condition or abrade this matrix material to expose fresh abrasive particles. Conditioning particles also may condition the composite binder, especially in a three-dimensional fixed abrasive article to expose fresh abrasive agglomerates.

Composite binder is used in the present invention to form three-dimensional fixed abrasive style regions in the abrasive article. This binder can be resin, glass, glass-ceramic, polymeric, adhesive, and the like. The binder can be formed of a curable (via energy such as UV light or heat) organic material. Examples include amino resins, alkylated urea-formaldehyde resins, melamine-formaldehyde resins, and alkylated benzoguanamine-formaldehyde resin, acrylate resins (including acrylates and methacrylates) such as vinyl acrylates, acrylated epoxies, acrylated urethanes, acrylated polyesters, acrylated acrylics, acrylated polyethers, vinyl ethers, acrylated oils, and acrylated silicones, alkyd resins such as urethane alkyd resins, polyester resins, reactive urethane resins, phenolic resins such as resole and novolac resins, phenolic/latex resins, epoxy resins such as bisphenol epoxy resins, isocyanates, isocyanurates, polysiloxane resins (including alkylalkoxysilane resins), reactive vinyl resins, phenolic resins (resole and novolac), and the like. The resins may be provided as monomers, oligomers, polymers, or combinations thereof. Hardness of the resin varies with the selected composition. For example, resin hardness generally ranges from at least about 18 kg/mm$^2$ for the softest epoxy or acrylate resins, and around 40 kg/mm$^2$ for phenolic resins.

The abrasive agglomerates of the present invention comprise a matrix material. This material holds the abrasive particles or primary abrasive grit together in the agglomerates, and the agglomerates are included in the abrasive composites. The matrix material can be a resin, a glass, a metal, a glass-ceramic, or a ceramic. For example, glass, such as silica glass, glass-ceramics, borosilicate glass, phenolic, epoxy, acrylic, and the other resins described in the context of the composite binder can be used. More preferably the matrix material comprises a hard, glassy, or brittle material which is then abraded by the conditioning particles in use to release fresh surfaces of primary abrasive grit. Typically, the matrix material is at least as hard as the composite binder, and it can be much harder, especially when made from a different material. For example, the matrix material can have a hardness of at least about 50, more preferably at least about 100, 200, 400, 600, or even harder (all in kg/mm$^2$). For example, silica glass can be used for the matrix material, with a hardness of about 500-600 kg/mm$^2$.

Erodible binder is used in the present invention to hold conditioning particles together in the article, and to release the particles during use. Preferably, the erodible binder controllable releases the particles, such as via erosion by the workpiece, or controlled dissolution by a working fluid or additive. Suitable materials include those described above in context of the composite binder. When the erodible binder releases conditioning particles through dissolution, useful binders include paraffin waxes, agar starches, sodium silicates, sodium carboxymethyl cellulose, methyl cellulose, polyvinylalcohol, polyvinylpyrrolidone, polyethyleneoxide or Carbowax™ polyethylene glycol solids from Dow Chemical, Midland, Mich. In addition, the workpiece itself can condition the conditioning amalgams, releasing conditioning particles. The conditioning particles of the invention need not be individual grit or abrasive particles, for they can also be agglomerates, aggregates, or combinations of these with or without individual grit particles.

Conditioning particles used in the present invention are sufficient to condition the composite binder and also may be sufficient to condition the matrix material of the abrasive agglomerates. That is, the conditioning particles have a size range and hardness combination that causes removal of composite binder and/or matrix material to expose fresh abrasive particles. These conditioning particles have a second hardness, which second hardness is less than the hardness of the workpiece and about the same or greater than the hardness of the composite binder. The second hardness also is about the same or greater than the hardness of the matrix material. Of course, the composite binder and the matrix material can be the same material. These conditioning particles do not appreciably abrade the intended workpiece. That is, the conditioning particles may abrade the workpiece given sufficient time, pressure, and other operating conditions. However, the rate of abrasion contributed by the conditioning particles is minimal, if even measurable. Thus, the primary abrasive particles act upon the workpiece while the conditioning particles act upon the matrix material of the abrasive agglomerates. For example, a typical lapping process may take several minutes to several hours to polish a workpiece, but the conditioning particles (of second hardness) would take at least several days, maybe weeks or months, to polish a similar workpiece or polishing may not occur to any substantial level in any reasonable time period.

Generally, when the conditioning particles are too large, they can prevent fixed abrasive article contact with the workpiece surface, reducing effectiveness. When the conditioning particles are too small, the dressing or conditioning is less effective and the polishing rate diminishes over time. In some embodiments of the present invention, the average particle size of the primary abrasive grit is larger than the average particle size of the conditioning particles. In another aspect, the conditioning particles of the second hardness have an average particle size from below about 125%, below about 100%, below about 75%, or even lower, relative to the average particle size of the abrasive particles of the first hardness. The conditioning particles have an average particle size preferably at least about 50% of the average particle size of the abrasive particles of the first hardness.

Abrasive articles useful in the invention may include a region of the abrasive composite particles along with a region substantially free of the abrasive composite particles. For example, features such as flow channels, wipers, slurry directors, and slurry retainers can be used with little or no abrasive particles.

In one embodiment, the region of abrasive composites and the region of conditioning amalgams are substantially coplanar. The regions can be provided in any suitable geometry. In one embodiment, the region of conditioning amalgams are sized similarly to the workpiece size, such that the workpiece can abrade or erode the conditioning abrasive amalgams to release conditioning particles or grit. This grit can be carried by a working fluid to form a conditioning slurry, which then acts upon the matrix material, effectively conditioning the primary abrasive of the invention.

Any known working fluid can be used. For example, water, aqueous solutions, and the like can be used, with particular selection within the skill of the art. Various additives also can be incorporated, such as lubricants, coolants, grinding aids, dispersants, suspending agents, and the like. Additives also may be used to chemically interact with the workpiece surface to improve the polishing process. In addition, chemistry can be used to controllable release the conditioning particles from the region of conditioning amalgams. That is, mechanical and/or chemical action can release the conditioning grit or particles into a liquid to comprise a conditioning slurry.

In one embodiment, the fixed abrasive article has regions of different abrasives that are capable of guiding fluid flow. For example, regions can guide conditioning slurry flow toward the center of a circular abrasive embodiment. In another example, regions can encourage conditioning slurry to flow toward the edge of an abrasive used in the invention.

The workpiece in the present invention has a hardness below the hardness of the primary abrasive, and above the hardness of the conditioning particles. The workpiece generally is abraded via brittle polishing or fracture-based grinding. Examples of workpiece materials include quartz, gallium arsenide, germanium, topaz, spinel, Aluminum Oxy Nitride (ALON), SiC, sapphire, and c-plane sapphire.

In one embodiment, the invention uses a fixed abrasive article to polish hard substrates, including abrasive particles of a hardness of at least about 2000, 2100, or 2200 kg/mm$^2$. These abrasive particles are included in a matrix material such as glass to form abrasive composites. In addition, a region of conditioning amalgams is included together with a region of abrasive composites on the same side of a substrate, such as a polymeric film (e.g., polyester). The conditioning amalgams contain conditioning particles with a hardness at least about 50, or even at least about 100 kg/mm$^2$ softer than the hardness of the abrasive particles. The composite binder can be a make coat and/or size coat, and the composite binder can hold abrasive composites into a three-dimensional abrasive article. In one aspect, the conditioning particles are below about 125%, below about 100%, or even below about 75% of the average particle size of the abrasive particles. In one aspect, the conditioning particles average particle size is at least about 50% of the average particle size of the abrasive particles. Alternatively, or in combination, the conditioning particles can be provided into a working fluid during the method of the invention. In some embodiments, the conditioning particles have an average particle size of below about 10 μm, below about 5 μm, below about 0.5 μm, or even below about 0.1 μm. In some embodiments, the abrasive particles have an average particle size above about 1 μm, above about 5 μm, about 8 μm, 10 μm, 15 μm, or even above about 20 μm. These abrasive particles are combined into agglomerates of any desired size. For example, agglomerates typically range from at least about three times the average particle size of the abrasive particles therein. Agglomerates typically range from below about 20 times the average particle size of the abrasive particles therein. In some aspects, the conditioning particles preferably are smaller than the abrasive particles. In one aspect, conditioning particles having an average particle size of about 5 μm are used with abrasive particles having an average particle size of about 8-10 μm, in agglomerates of about 150-200 μm particle size. For example with a sapphire workpiece, 8-10 μm diamond particles can be used in agglomerates of about 170-190 μm particle size, together with alumina conditioning particles of 1-5 μm.

The abrasive articles useful in the invention can be made via any known method for making a coated abrasive or an abrasive article having three-dimensional, textured abrasive composites. For example, abrasive agglomerates and conditioning abrasive can be provided in regions upon one of the substrates described above, and attached using a binder as described above. In addition, any known size coat can be provided over the agglomerates and conditioning abrasive. For another example, a substrate having a structured surface (e.g., peaks and valleys, shaped features such as pyramids, cubes, trapezoids, and the like) can be used, with the abrasive agglomerates and conditioning abrasive provided in separate regions. In another example, abrasive composites containing abrasive agglomerates can be used to form a structured surface while the conditioning abrasive regions can be provided around the structured surface.

Useful methods are described in U.S. Pat. Nos. 5,152,917 and 5,435,816 which are herein incorporated by reference. Other descriptions of suitable methods can be found in U.S. Pat. Nos. 5,437,754; 5,454,844; 5,435,816; and 5,304,223; all herein incorporated by reference. Abrasive agglomerates suitable for inclusion in the three-dimensional, textured abrasive composites may be manufactured by any known method, such as those described in U.S. Pat. Nos. 6,551,366; 6,645,624; 5,651,729; 5,975,988; and 4,799,939. Another useful method of making useful abrasive articles having three-dimensional, textured abrasive composites wherein the composites comprise abrasive agglomerates fixed in a make coat, with optional size coatings, is described in U.S. Pat. No. 6,217,413.

The invention generally is useful in grinding or lapping or polishing operations, especially with hard or brittle workpieces. In one aspect, the inventive method maintains the cut rate on the workpiece at a desired level for extended time periods without the need for a separate, or off-line, abrasive dressing or conditioning process. In another aspect, the invention provides an improved removal rate stability and predictability, which improves process efficiency and reduces scrap during finishing operations. The process of this invention allows the same fixed abrasive article to be effective on a wide variety of workpiece materials.

Objects and advantages of this invention are further illustrated by the following examples, but the particular materials and amounts thereof recited in these examples, as well as other conditions and details, should not be construed to unduly limit this invention.

EXAMPLES

Preparation of Vitreous Bonded Diamond Agglomerates

Vitreous bonded diamond agglomerates were produced generally using the method of U.S. Pat. No. 6,319,108. First, a temporary binder solution was prepared by dissolving 25 parts by weight (pbw) dextrin (available as "STANDEX 230" from A.E. Stanley Mfg. Co., Decatur, Ill.) in 75 pbw deionized water.

A slurry comprising 170.0 g of the temporary binder solution, 4.0 g of a 50 wt % solution of AY 100 surfactant (available from Cytek Industries, Stamford, Conn.) in methyl ethyl ketone, and 1.3 g Dow Corning Additive 65 (a silicone emulsion anti-foaming agent available from Dow Corning Corp., Midland, Mich.) were thoroughly mixed with a propeller mixing blade for 15-20 minutes. Milled glass frit was prepared by charging 20 g methanol with 800 g glass frit (SP1086 glass from Specialty Glass Inc., Oldsmar, Fla.) into a Number 2 milling jar (8.3 L (2.2 gallon)), made of alumina-fortified porcelain from U.S. Stoneware, East Palestine, Ohio. The jar also contained about 16.9 kg of 0.6-cm (0.25 inch) zirconia milling pellets. The combination was milled for 72 h at about 130 rpm, then the mill was discharged. A quantity of 200.0 g of the milled glass frit was added to the slurry and mixing continued for 20 minutes. Diamond abrasive particles having a nominal particle size of 20 μm (available from National Research Corp., Chesterfield, Mich.) were then added to the slurry and the combination was mixed for an additional 20 minutes.

The resulting slurry was then coated into the cavities of a polypropylene tool and the excess slurry was removed using a doctor blade. The tool was made according to the teachings of U.S. Pat. No. 5,152,917. The cavities in the polypropylene tool were in the form of truncated four-sided pyramids having a depth of 178 μm, an opening of 246 μm by 246 μm and a base of 151 μm by 151 μm. The slurry in the cavities of the tool was air dried at room temperature for 24 hours. After drying, the dried abrasive composite precursors were urged from the tool by contacting the back surface of the tool with an ultrasonically driven vibrating titanium bar (available as Branson 902R, from Branson Ultrasonic Instruments, Danbury, Conn.).

The dried precursor particles were passed through standard sieves of 250 μm opening followed by 150 μm. The dried precursor particles remaining on the 150 μm opening sieve were mixed with an inorganic parting agent consisting of Boehmite powder (alumina monohydrate, Disperal, commercially available from Condea Chemie GmbH, Brunsbuttel, Germany) at a ratio of 100 g dried precursor particles to 6 g Boehmite powder. The dried precursor and parting agent mixture was fired in a refractory sager (available from Ipsen Ceramic, Pecatonica, Ill.). The firing temperature was ramped from room temperature to 400° C. at a rate of 1.5° C. per min. and was then held at 400° C. for 2.0 h to burn off the temporary binder. The precursors were then heated to 720° C. at a rate of 2° C. per min. and were held at 720° C. for 1.0 h in an air atmosphere. Following firing, the resulting porous ceramic abrasive composites were cooled to room temperature at a rate of about 2° C. per min. The fired porous ceramic abrasive composites were passed through standard sieves of 250 μm opening followed by 150 μm to remove the inorganic parting agent. The fired porous ceramic abrasive composites remaining on the 150 μm opening were then collected for use in the abrasive articles.

Preparation of Abrasive Agglomerates Dispersed in Binder Precursor

A dispersant solution of 25 wt % dispersant (Solsperse™ 32000, available from Noveon Division, Lubrizol Ltd., Manchester, U.K.) and 75 wt % acrylate resin (SR 368 D, available from Sartomer Co., Inc., Exton, Pa.) was mixed for approximately 1 h using an air driven propeller mixer. Vazo 52 thermal initiator (available from Dupont Chemical Solution Enterprise, Bell, W.Va.) was crushed prior to mixing into the resin by placing the Vazo 52 in a sealed plastic bag, placing the bag on a sturdy surface (lab bench top), and using a ceramic mortar to break up the Vazo 52 into fine particulates. During mixing the mixture was placed in a heated water bath (60° C.) to facilitate melting of the dispersant into the resin. A thermal initiator solution was produced by mixing 5 wt % Vazo 52 into 95 wt % acrylate resin (SR368 D) using a propeller mixer. The thermal initiator solution was stored in a refrigerator (temperature<40° C.). Calcium metasilicate (NYAD M400 Wollastonite, available from NYCO Minerals Inc., Hermosillo Sonora, Mexico) was dried before use by placing the NYAD M400 into a metal container and heating the container in an oven set at 120° C. for 2 to 4 days. The NYAD M400 was then cooled to room temperature and the container sealed with vinyl tape until use. A resin pre-mix was produced by mixing the following components using a high speed Cowels blade mixer: 91 wt % 368 D resin, 8 wt % dispersant solution described above, and 1 wt % photoinitiator (Irgacure 819, available from Ciba Specialty Chemicals, Tarrytown, N.Y.). This was mixed for approximately 1 h until the photoinitiator had dissolved, to form a resin pre-mix.

An abrasive slurry was produced by mixing 1547.8 g of resin premix described above with 2935 g of NYAD M400 Wollastonite, 100 g 180 μm vitrified diamond agglomerates produced as described above, 45 g fumed silica (OX 50, available from Degussa Corporation, Parsippany, N.J.), and 2.5 g antifoam (Dow Corning Additive #7, available from Dow Corning Corp.) under high shear for 1 h. The mixture was then placed in a sealed plastic pail and rotated at 20 rotations per minute (rpm) on a roller mill (available from U.S. Stoneware) for 18-24 h to form a slurry. The slurry was then removed from the roller mill and mixed under low shear, during which 370 g of thermal initiator solution described above was added. The slurry was mixed for approximately 30 min. or until the temperature reached 32° C. (90° F.).

Fixed Abrasive Article Preparation (Method I)

This abrasive article was made generally as described in U.S. Pat. No. 5,958,794 (Bruxvoort, et al.) on an apparatus similar to that illustrated in FIG. 15 of this patent.

A polypropylene tool was provided comprising an array of cavities. The cavities in the tool were in the form of inverted truncated four-sided pyramids having a depth of 800 μm, an opening of 2800 μm by 2800 μm and a base of 2518 μm by 2518 μm with a center-to-center spacing of 3976 μm. The tool was essentially the inverse of the desired shape, dimensions, and arrangement of the abrasive composites.

The tool was unwound from a winder. The dispersion of abrasive agglomerates in abrasive composite binder precursor was coated and applied into the cavities of the tool using a vacuum slot die coater at room temperature. Next, a polyester backing (127 μm thick (5 mil) polyester film having an ethylene acrylic acid co-polymer primer on the surface to be coated—125 μm (5 mil) Scotchpak™ available from 3M Company, St. Paul, Minn.) was contacted with the abrasive slurry-coated tool such that the abrasive slurry wetted the primed surface of the backing. Ultraviolet (UV) light radiation was transmitted through the tool and into the abrasive slurry. Two different UV lamps were used in series. The first UV lamp was a Fusion System "V" bulb and operated at 236.2 W/cm (600 Watts/inch). The second was a Fusion System "D" bulb and operated at 236.2 W/cm (600 W/inch). Upon exposure to UV radiation, the binder precursor was converted into a binder and the abrasive slurry was converted into an abrasive composite. The tool was removed from the abrasive composite/backing. The abrasive composite/backing was then exposed to an additional treatment of UV radiation, through the backing side, using the Fusion System "D" bulb and operated at 236.2 W/cm (600 W/inch).

Then, the abrasive composite/backing, which formed the abrasive article, was wound upon a core. This was a continuous process operated at between about 4.6 to 7.6 m/min. (15 to 25 feet/min.). The abrasive composite/backing wound up on the a core was then heated for approximately 8 h in an oven set at 80 to 105° C. to complete the cure of the binder systems and to activate the primer on the polyester backing.

To prepare the abrasive article for testing, abrasive composite/backing sheets were laminated to a 0.762 mm (0.030 inch) thick polycarbonate sheet (Lexan™ 8010MC, available from GE Polymer Shapes, Mount Vernon, Ind.) using a pressure sensitive adhesive tape ("442 KW", available from 3M, St. Paul, Minn.). A 30.48 cm (12 in.) diameter circular test sample was die cut for testing.

Conditioning Amalgam Article—Method II

A conditioning amalgam precursor mixture of 75 g of 15 μm conditioning particles (PWA alpha alumina, available as Microgrit PWA 15, from Fujimi Corporation, Wilsonville, Oreg.), 5 g of dispersant (Disperbyk 180, from BYK-Chemie, Wallingford, Conn.), 20 g of trimethylolpropane triacrylate (TMPTA) (Sartomer SR351, from Sartomer Company, Inc., Exton, Pa.), and 1.0 g photoinitiator (Irgacure 819, from Ciba Specialty Chemicals, Tarrytown, N.Y.) was prepared and converted into a conditioning amalgam as described in Method I. Segments were then die cut to fit openings in a previously prepared 30.48 cm (12 in.) disk of a fixed abrasive article prepared by Method I.

Conditioning Amalgam Article—Method III

After developing the conditioning amalgam article by Method II, the conditioning amalgam structure was flooded and filled with the conditioning amalgam precursor of Method II, leveled with a polypropylene release backing and UV cured to produce a planar conditioning abrasive sheet. Segments were then die cut to fit openings in a previously prepared 30.48 cm (12 in.) disk of a fixed abrasive article prepared by Method I.

Conditioning Amalgam Article—Method IV

After producing a fixed abrasive article by Method I, regions to be replaced by planar conditioning amalgam features were removed from the abrasive face of a 30.5 cm (12 in.) disk to provide gaps.

A conditioning amalgam precursor mixture of 20 g resole resin (75 wt % solids in water, 1.5:1 by weight formaldehyde: phenolic, 2.5% KOH catalyzed), 80 g 15 μm conditioning particles (PWA alpha alumina, Microgrit PWA 15), 15 g water, and 15 g isopropyl alcohol was prepared. This mixture was used to fill the gaps in the fixed abrasive article and leveled with a rubber knife or squeegee. The abrasive was then cured in an oven set at 60° C. for 30 min., 85° C. for 30 min., 105° C. for 30 min., and 120° C. for 2 h to form a fixed abrasive article.

Test Method A—Single Sided Lapping Test

Tests were performed on the Phoenix 4000 single sided lapping machine obtained from Buehler Ltd., Lake Bluff, Ill. A fixed abrasive pad was mounted to the platen using a pressure sensitive adhesive. The diamond fixed abrasive pad was prepared for testing by initial conditioning using an alumina fixed abrasive (268 XA-A35, available from 3M Company). The 268 XA alumina fixed abrasive was mounted to three, 65 mm (2.56 in.) diameter×3.18 mm (0.125 in.) thick Borofloat™ glass disks (Swift Glass, Elmira, N.Y.). The three Borofloat™ disks with the 268 XA abrasive on their surface were mounted to a 152 mm (6 in.) diameter×15 mm (0.6 in.) thick aluminum metal plate using mounting wax (Crystalbond 509 Clear, Aremco Products, Inc., Calley Cottage, N.Y.) to form a conditioning plate. The conditioning plate was attached to the upper head of the lapping machine with a quick disconnect mount. The lapping machine was run at an applied pressure of 34.5 kPa (5 psi) for 1 minute using a 180 rpm platen and a counter rotating 100 rpm substrate. During conditioning, 10 vol % Sabrelube 9016 (Chemetall Oakite, Lake Bluff, Ill.) in deionized water was supplied at a flow rate of 30 mL/min. The initial conditioning process was completed by lapping Borofloat™ glass (three 65-mm substrates affixed to a metal plate with mounting wax) at 55.2 kPa (8 psi) for 5 min. using machine conditions described above. Prior to each sapphire lapping test, window glass substrates (Swift Glass) were lapped using a pressure of 34.5 kPa (5 psi) and the specified machine conditions for between 8-9 min. until a stable window glass removal rate of between 330-360 μm/min was achieved. The removal rate of the window glass substrates and the sapphire workpieces was calculated by converting the weight loss during lapping (M in grams) to thickness removed (T in μm) by using the following equation:

$$T=10{,}000*M/(A*D)$$

where A=area of the substrate ($cm^2$) and D=density of the substrate ($g/cm^3$), and sapphire had a density of 3.9 $g/cm^3$ and window glass had a density of 2.4 $g/cm^3$.

Each of the self-contained conditioning abrasive articles of the Examples below was laminated to a polycarbonate sheet (30.5 cm (12 in.)) diameter using double-sided adhesive and the fixed abrasive was trimmed to that diameter. Lapping runs of 5 min. each were conducted at 34.5 kPa (5 psi) using the machine conditions specified on C-plane sapphire (Crystal Systems, Salem, Mass.). Results are shown in Table I, below.

Test Method B—Double Sided Lapping

Tests were performed using an AC 500 double-sided lapping machine available from Peter Wolters, Rendsburg, Germany. Fixed abrasive pads to be tested were mounted to both lower and upper platens using pressure sensitive adhesive. The diamond fixed abrasive pad was prepared for testing by initial conditioning using an alumina fixed abrasive (268 XA-A35—commercially available from 3M Company, St. Paul, Minn.). The 268 XA alumina fixed abrasive was mounted to the top and bottom of five blank (no part holes) part carriers. The conditioning carriers were run for a total of 1 minute at a pressure of 10.9 kPa (1.6 psi) using the machine conditions as follows: Upper Platen Speed 96 rpm clockwise; Lower Platen Speed 96 rpm counterclockwise; Sun Gear Speed 14 rpm (either clockwise or counter clockwise); Coolant Flow 200 mL/min.; and rate of Lapping Fluid (10 vol % of Sabrelube™ 9016 in deionized water) of 100 mL/min. The direction of rotation of the sun gear was switched half way through the 1 minute cycle. Pad preparation was completed by running three 5-minute batches of fifteen 65-mm Borofloat™ glass substrates at 13.9 kPa (2 psi) at the machine conditions listed above.

Example 1

A fixed abrasive article was prepared by inserting eight 5-cm diameter circular regions of planar conditioning amalgam segments prepared by Method III into a 30.5 cm (12 in.) disk of a fixed abrasive article prepared by Method I. The eight disks were evenly spaced around the perimeter approximately 3.8 cm (1.5 in.) from the edge.

Example 2

A fixed abrasive article was prepared by inserting eight 5-cm diameter circular regions of textured conditioning amalgam segments prepared by Method II into a 30.5 cm (12 in.) disk of a fixed abrasive article prepared by Method I. The eight disks were spaced as in Example 1.

Example 3

A fixed abrasive article was prepared by cutting a 30.5 cm (12 in.) disk from a sheet having alternating stripes of the fixed abrasive article prepared by Method I and the textured conditioning amalgam segment prepared by Method II. The stripes of fixed abrasive article were 5 cm (2 in.) wide and the stripes of textured conditioning amalgam were 2.54 cm (1 in.) wide.

Example 4

A fixed abrasive article was prepared by inserting eight 5 cm diameter circular regions of planar conditioning amalgam segment prepared by Method IV into a 30.5 cm (12 in.) disk of a fixed abrasive article prepared by Method I. The eight disks were evenly spaced around the perimeter approximately 3.8 cm (1.5 in.) from the edge.

Example 5

A fixed abrasive article was prepared by inserting sixteen 2.5-cm diameter circular regions of planar conditioning amalgam segment prepared by Method IV into a 30.5 cm (12 in.) disk of a fixed abrasive article prepared by Method I. The eight disks were spaced as in Example 1 but approximately 5 cm (2 in.) from the edge.

Example 6

A fixed abrasive article was prepared by inserting two concentric rings of planar conditioning amalgam segment prepared by Method IV into a 30.5 cm (12 in.) disk of a fixed abrasive article prepared by Method I. The first ring was 1.27 cm (0.5 in.) wide with an inner diameter of 6.35 cm (3 in.). The second ring was 1.6 cm (0.63 in.) wide with an inner diameter of 10.2 cm (4 in.).

Example 7

A fixed abrasive article was prepared by inserting two concentric planar conditioning amalgam segments prepared by Method IV into a 30.48 cm (12 in.) disk of a fixed abrasive article prepared by Method I to obtain nested squares of alternating fixed abrasive material and planar conditioning materials. The central square of fixed abrasive material was 8.9×8.9 cm (3.5×3.5 in.) surrounded by stripes of planar conditioning material 0.66 cm (0.25 in.) wide, surrounded by stripes of structured fixed abrasive 0.94 cm (0.38 in.), surrounded by a second set of stripes of planar conditioning material 3.18 cm (1.25 in.) wide, all centered in the 30.5 cm disk.

Comparative Example A

A fixed abrasive article was prepared by Method I and tested using Test Method A.

Examples 8-10 and Comparative Example B (CE-B)

In Examples 8-10, a diamond fixed abrasive was produced according the Method III (above) and tests as per Test Method A while the conditioning particles were supplied in the Lapping Fluid (10 vol % solution of Sabrelube™ 9016 coolant in de-ionized water). Comparative Example B used the same fixed abrasive but no conditioning particles. The results are shown below in Table II.

In Example 8, approximately 1 volume percent (vol %) of milled glass frit (SP 1086) was added to the Lapping Fluid. The coolant mixture was stirred constantly during the test. The removal rate dropped by over 92% within the first 15 minutes of lapping.

In Example 9, approximately 1 vol % of 3 μm conditioning particles (MICROGRIT PWA 3 alumina powder, available from Fujimi Corp., Wilsonville, Oreg.) was added to the Lapping Fluid. The coolant mixture was stirred constantly during the test. The removal rate dropped by over 92% within the first 15 minutes of lapping.

In Example 10, approximately 1 vol % of 15 μm conditioning particles (MICROGRIT PWA 15 alumina powder, available from Fujimi Corp.) was added to the Lapping Fluid. The coolant mixture was stirred constantly during the test. Although the removal rate dropped by 29% after the first 10 minutes of lapping, it then stabilized at an average value of 29.4 μm/min. out to 30 minutes of lapping time.

In Comparative Example B, the Lapping Fluid was used without conditioning particles. Within 15 minutes of lapping the removal rate had dropped by over 95%.

TABLE I

| Example | Cumulative Time (min.) | Removal Rate (μm/min.) |
|---|---|---|
| 1 | 11 | 50.3 |
| | 21 | 40.9 |
| | 31 | 39.1 |
| | 41 | 50.3 |
| | 46 | 44.7 |
| 2 | 11 | 27.6 |
| | 21 | 2.3 |
| 3 | 5 | 32 |
| | 10 | 24 |
| | 15 | 15 |
| | 20 | 10 |
| 4 | 10 | 112.8 |
| | 20 | 77.9 |
| | 30 | 81.5 |
| | 40 | 71.5 |
| | 50 | 25.6 |
| | 60 | 70.1 |
| | 70 | 22.2 |
| 5 | 10 | 54.4 |
| | 20 | 2.0 |
| | 30 | 3.9 |
| | 35 | 1.5 |
| 6 | 10 | 83.6 |
| | 20 | 78.7 |
| | 30 | 11.1 |
| | 40 | 3.0 |
| 7 | 10 | 72.8 |
| | 20 | 17.9 |
| | 30 | 10.2 |
| | 40 | 27.3 |
| | 50 | 35 |
| CE-A | 5 | 17 |
| | 10 | 2 |
| | 15 | 1 |

TABLE II

Single Side C-Plane Sapphire Lapping Results

| Example | Cumulative Time (min.) | Removal Rate (μm/min.) | Lapping Fluid Additive |
|---|---|---|---|
| 8 | 5 | 6.7 | 1 vol. % |
| | 10 | 0.9 | milled glass |
| | 15 | 0.5 | |
| 9 | 5 | 7.0 | 1 vol. % |
| | 10 | 0.8 | 3 micron alumina |
| | 15 | 0.8 | |
| | 20 | 0.5 | |
| 10 | 5 | 45.4 | 1 vol. % |
| | 10 | 32.1 | 15 micron alumina |
| | 15 | 27.0 | |
| | 20 | 29.7 | |
| | 25 | 29.6 | |
| | 30 | 28.8 | |
| CE- B | 5 | 16.8 | Coolant |
| | 10 | 1.2 | Only |
| | 15 | 0.7 | |

Example 11 and Comparative Example C (CE-C)

Diamond fixed abrasives were produced according to Method III. Double Sided lapping tests were conducted according to Test Method B.

In Example 4, Test Method B was used with the exception that only a 2 minute Borofloat™ lapping run was used to prepare the pad. This Borofloat™ run was followed by 5 batches of fifteen 65-mm diameter Window Glass substrates. Each window glass batch was run at 13.9 kPa (2 psi ) for 2 min. (with the first batch being for 5 min.). A series of sapphire lapping runs were performed on batches of ten 50-mm c-plane sapphire substrates. Each of these batches was run at the machine conditions listed in Test Method B with the exception that the lapping fluid used was a 1 vol % mixture of 15 μm alumina (PWA 15) in the 10 vol % solution of Sabrelube™ 9016. The results are shown in Table III. The substrate removal rate observed did not substantially change (i.e., vary by more than 15% of initial value) for lapping pressures of 51.4 kPa (7.5 psi), 31.1 kPa (4.5 psi), 20.4 kPa (3.0 psi), or 10.2 kPa (1.5 psi), even after extended lapping times. That is, for a given pressure, removal rate remained stable.

In Comparative Example B, ten 50-mm c-plane sapphire parts were lapped (four 10-minute batches) using an applied pressure of 34.1 kPa (4.9 psi), 10 vol % solution of Sabrelube™ 9016 in deionized water, and the machine conditions shown in Test Method B. The results are shown in Table III. The removal rate dropped by over 85% after 40 minutes of lapping, despite maintaining relatively high pressure.

TABLE III

Double Side Lapping Tests with Conditioning Abrasives

| Example | Cumulative Time (min.) | Pressure-kPa (psi) | Removal Rate (μm/min.) |
|---|---|---|---|
| 4 | 10 | 34.5 (5) | 47.1 |
| | 20 | 20.7 (3) | 24.5 |
| | 30 | 20.7 (3) | 25.3 |
| | 40 | 13.8 (2) | 15.8 |
| | 50 | 13.8 (2) | 13.9 |
| | 60 | 13.8 (2) | 13.8 |
| | 70 | 13.8 (2) | 14.4 |
| | 80 | 6.9 (1) | 4.7 |
| | 90 | 6.9 (1) | 4.0 |
| CE-C | 10 | 34.1 (4.9) | 8.2 |
| | 20 | 34.1 (4.9) | 2.0 |
| | 30 | 34.1 (4.9) | 1.6 |
| | 40 | 34.1 (4.9) | 1.2 |

It is apparent to those skilled in the art from the above description that various modifications can be made without departing from the scope and principles of this invention, and it should be understood that this invention is not to be unduly limited to the illustrative embodiments set forth hereinabove. All publications and patents are herein incorporated by reference to the same extent as if each individual publication or patent was specifically and individually indicated to be incorporated by reference.

We claim:

1. A method of polishing comprising:

providing a workpiece having a hardness of at least about 600 kg/mm$^2$;

providing a fixed abrasive article comprising a substrate having a first surface and a region of abrasive composites distributed on the first surface of the substrate, the abrasive composites including a binder and abrasive particles having a first hardness, wherein the first hardness is higher than the workpiece hardness;

providing conditioning particles having a second hardness selected to abrade the abrasive composites without appreciably abrading the workpiece, wherein the second hardness is less than the hardness of the workpiece; and relatively moving the workpiece and the fixed abrasive article in the presence of the conditioning particles to condition the fixed abrasive article by abrading the abrasive composites, and to modify the surface of the workpiece.

2. The method of claim 1 wherein the abrasive particles of the fixed abrasive article are provided together with a matrix material in agglomerates.

3. The method of claim 2 wherein the second hardness is selected to condition the fixed abrasive article by abrading the matrix material of the agglomerates.

4. The method of claim 1 further comprising modifying the workpiece surface in the presence of a liquid medium.

5. The method of claim 1 wherein the conditioning particles are provided in a slurry.

6. The method of claim 1 wherein the conditioning particles are provided in a region of conditioning composites on the substrate adjacent to the region of abrasive composites, wherein the conditioning composites comprise conditioning particles and erodible binder.

7. The method of claim 6 wherein the conditioning particles have an average particle size below the average particle size of the abrasive particles of the first hardness, optionally wherein the regions of abrasive composites and regions of conditioning composites are substantially coplanar.

8. The method of claim 1 wherein the conditioning particles have an average particle size from about 50 to 100% of the average particle size of the abrasive particles.

9. The method of claim 1 wherein the fixed abrasive article further comprises a region substantially free of the abrasive composites, which may include fluid channels.

10. The method of claim 1 wherein the binder comprises a resin, a glass, a metal, a glass-ceramic, or a ceramic.

11. The method of claim 1 wherein the abrasive particles comprise diamond or silicon carbide, boron carbide, cubic boron nitride, or a combination thereof.

12. The method of claim 1 wherein the conditioning particles comprise alumina, corundum, zirconia, ceria, glass, or a combination thereof.

13. The method of claim 1 wherein the second hardness is selected to condition the fixed abrasive article by abrading the binder.

14. The method of claim 1 wherein the binder is selected to have a third hardness less than the hardness of the workpiece, and wherein the workpiece conditions the fixed abrasive article by abrading the binder.

15. The method of claim 1 wherein the substrate of the abrasive article and the binder are substantially the same material.

16. A method of polishing comprising:

providing a workpiece having a hardness of at least about 600 kg/mm$^2$;

providing a fixed abrasive article comprising a substrate having a first surface and a region of abrasive composites distributed on the first surface of the substrate, the abrasive composites including a binder and abrasive agglomerates, which agglomerates include abrasive particles of a first hardness together with a matrix material, and wherein the first hardness is higher than the workpiece hardness;

providing a slurry of working fluid and conditioning particles, which particles have a second hardness that is selected to abrade the matrix material of the abrasive agglomerates without appreciably abrading the workpiece, wherein the second hardness is less than the hardness of the workpiece; and in the presence of the slurry and the conditioning particles, relatively moving the workpiece and the fixed abrasive article to modify the surface of the workpiece.

17. method of claim 16 wherein the agglomerates comprise an abrasive suitable for polishing sapphire.

18. The method of claim 16 wherein the conditioning particles have a hardness below about 2100 kg/mm$^2$.

19. The method of claim 16 wherein the abrasive particles have a Knoop hardness above about 2500 kg/mm$^2$.

20. The method of claim 16 further comprising attaching the fixed abrasive article to a polishing machine with an adhesive, optionally wherein the adhesive is a pressure-sensitive adhesive.

21. The method of claim 14 wherein the second hardness is greater than the third hardness.

* * * * *

UNITED STATES PATENT AND TRADEMARK OFFICE

CERTIFICATE OF CORRECTION

PATENT NO. : 7,494,519 B2
APPLICATION NO. : 11/191711
DATED : February 24, 2009
INVENTOR(S) : Timothy D. Fletcher It is certified that error appears in the above-identified patent and that said Letters Patent is hereby corrected as shown below:

Column 11,
Line 16, delete the word "Disperal" and insert --Dispersal--, therefor.

Column 19,
Line 4, Claim 17, before the word "method" insert --The--, therefor.

Signed and Sealed this

Twenty-eighth Day of July, 2009

John Doll

JOHN DOLL
*Acting Director of the United States Patent and Trademark Office*